US007815742B2

(12) United States Patent
Falkenstein

(10) Patent No.: US 7,815,742 B2
(45) Date of Patent: Oct. 19, 2010

(54) METHOD AND DEVICE FOR THE INTERNAL CLEANING OF A TANK

(75) Inventor: Thomas Falkenstein, Lorch (DE)

(73) Assignee: Thomas Falkenstein Gewerbliche Vermietung und Verpachtung E.K., Schorndorf-Schlichten (DE)

( * ) Notice: Subject to any disclaimer, the term of this patent is extended or adjusted under 35 U.S.C. 154(b) by 500 days.

(21) Appl. No.: 11/739,467

(22) Filed: Apr. 24, 2007

(65) Prior Publication Data

US 2008/0035205 A1 Feb. 14, 2008

(30) Foreign Application Priority Data

Apr. 25, 2006 (DE) ..... 10 2006 020 427

(51) Int. Cl.
*B08B 9/00* (2006.01)
*B08B 7/04* (2006.01)

(52) U.S. Cl. ..... 134/22.1; 134/10

(58) Field of Classification Search ..... 134/10, 134/22.1–24; 137/15.04; 15/300; 417/63
See application file for complete search history.

(56) References Cited

U.S. PATENT DOCUMENTS

| | | | | |
|---|---|---|---|---|
| 4,770,711 A | | 9/1988 | Deal, III et al. | 134/18 |
| 5,085,710 A | | 2/1992 | Goss | 134/22.14 |
| 5,565,070 A | * | 10/1996 | Doi et al. | 203/91 |
| 5,755,389 A | | 5/1998 | Miyasaki | 241/91 |
| 2002/0153279 A1 | | 10/2002 | Kim et al. | 208/13 |
| 2005/0167362 A1 | * | 8/2005 | Sakakura et al. | 210/634 |
| 2007/0283981 A1 | * | 12/2007 | Stewart | 134/10 |

FOREIGN PATENT DOCUMENTS

| | | | |
|---|---|---|---|
| EP | 0 589 698 A1 | | 3/1994 |
| EP | 1 498 190 | * | 1/2005 |
| EP | 1 498 190 A1 | | 1/2005 |

* cited by examiner

*Primary Examiner*—Michael Kornakov
*Assistant Examiner*—Stephen Ko
(74) *Attorney, Agent, or Firm*—Pierce Atwood, LLP; Erik Saarmaa

(57) ABSTRACT

A method for the internal cleaning of a tank. An oil sump and a gas mixture which is diffused out of the oil sump and has a hydrocarbon-containing gas being present in the crude-oil tank. The gas mixture is sucked away out of the tank and a feed of an inert gas into the tank is permitted. An energy content of the sucked-away gas mixture is determined. The gas mixture is fed to a compressor for compressing the gas mixture, if the energy content of the gas mixture overshoots a limit value, in order to compress the gas mixture in the compressor. The gas mixture is fed to a consumer unit, if the energy content of the gas mixture undershoots the limit value.

11 Claims, 2 Drawing Sheets

METHOD AND DEVICE FOR THE INTERNAL CLEANING OF A TANK

BACKGROUND OF THE INVENTION

The invention relates to a method for the internal cleaning of a tank, in particular a crude-oil tank, an oil sump and a gas mixture which is diffused out of the oil sump and has a hydrocarbon-containing gas being present in the crude-oil tank.

The invention relates, furthermore, to a device provided for this purpose and to a cleaning vehicle provided for this purpose.

A method and a device for the internal cleaning of a tank, in particular of a crude-oil tank, are generally known.

Crude-oil tanks are used for the storage of relatively large quantities of crude oil with a capacity of approximately 100 000 $m^3$. Crude-oil tanks of this type may be designed, for example, as floating-top tanks, in which a disc-shaped roof floats on the crude oil and can move up and down in a vertical direction when crude oil flows in or flows out.

Over the years, deposits form on the bottom of crude-oil tanks of this type, which occur as a result of the sinking of heavy constituents of the crude oil and are designated as gatch or crude-oil sump. The deposits often have a sediment-like solid consistency and a comparatively greasy surface. The type and thickness of the deposits depend, inter alia, on the grade of crude oil stored, on the storage quantity, on the transfer frequency and on the tank size. The deposits have to be removed at regular intervals, for which purpose, as a rule, the crude oil is first discharged and then the deposits are removed from the tank bottom mechanically.

After the crude oil has been discharged, a gas and/or vapour mixture occurs above the crude-oil sump. The gas and/or vapour mixture has gases which are diffused out of the crude-oil sump and, as a rule, comprise volatile hydrocarbon compounds. The content of the hydrocarbon-containing gas and/or vapour mixture in the interior of the tank may amount to 30 000 ppm after the discharge of the crude oil. Before the removal work can be carried out, the gas and/or vapour mixture which has occurred above the crude-oil sump has to be sucked away. This is necessary, since the cleaning work is normally performed by cleaning personnel and, for reasons of work safety, the gases harmful to health must be removed from the interior of the tank. Before personnel can enter the tank for cleaning purposes, the concentration of the hydrocarbons in the interior of the tank must be lower than 2000 ppm, as prescribed in work safety regulations.

Even when cleaning vehicles are used, which, as a rule, are robot-like crawler vehicles, the presence of a gas mixture is not desirable, since this gas mixture is, as a rule, ignitable when it comes into contact with oxygen.

BRIEF SUMMARY OF THE INVENTION

The object of the invention, therefore, is to provide a method and a device for cleaning a crude-oil tank. The object of the invention, furthermore, is to provide a cleaning vehicle of this type.

In a method of the type mentioned in the introduction, this object is achieved in that the gas mixture is first sucked away out of the tank and in that it is permitted at the same time that an inert gas is fed into the tank, in that the energy content of the sucked-away gas mixture is determined, in that the gas mixture is fed to a compressor for compressing the gas mixture, if the energy content of the gas mixture overshoots a limit value, in order to compress the gas mixture in the compressor, and in that the gas mixture is fed to a consumer unit, if the energy content of the gas mixture undershoots the limit value.

A gas mixture is always understood below to mean a gas and/or a vapour mixture which has a mixture of volatile hydrocarbon compounds and/or vapour. The vapour is understood to mean a substance in a gaseous state of aggregation, which at the same time is also present as liquid, here as crude oil, the gas and the liquid being in contact with one another. As a rule, the liquid is mixed in the form of small liquid droplets in the gas. The composition of the gas mixture, as a rule, is not known and is subject to fluctuations. It is advantageous to determine the energy content of the gas mixture, in order as far as possible to deliver the gas mixture for further use.

The determination of the energy content may involve determining a calorific value and/or a straightforward quantity determination of a volume fraction of the combustible constituents. The determination of the volume fraction of combustible gases in the gas mixture may take place, for example, by means of chromatographic methods, such as gas chromatography, or contactlessly by means of infrared sensors. The calorific value may be determined, for example, by measuring the heat tone, in that a small measurement volume is burnt and the heat in this case released is determined.

The gas mixture with a high energy content has, as a rule, a high fraction of combustible gases. Sine the crude-oil sump has a mixture of hydrocarbon compounds of differing solidity, the gas mixture comprises, as a rule, a mixture of different volatile combustible components, such as methane, ethane, propane and butane. Since in the combustion of a heavier hydrocarbon, such as, for example, butane, more energy per mole is released than in the case of the light methane, the energy content of the gas mixture is determined both by the quantity of combustible hydrocarbons and by their composition.

One example of a simply combustible hydrocarbon-containing gas mixture is, for example, natural gas which has combustible constituents, mainly methane, and incombustible constituents, mainly carbon dioxide and noble gases. According to the energy content, natural gas is divided into low-grade gas with a low energy content on account of a low fraction of methane of approximately 79.8-87 percent by volume and high-grade gas with a high energy content on account of the high fraction of methane of approximately 87-99.1 percent by volume. This corresponds to a calorific value of approximately 10 kWh/kg for low-grade gas and of approximately 14 kWh/kg for high-grade gas, the calorific value being the overall heat quantity which is released in the event of a complete combustion of the gas mixture. The value of 87 percent by volume of methane can therefore be used, for example in natural gas, as a limit value according to the invention.

Differentiating the gas mixture, using a limit value for the energy content of the gas mixture, is advantageous, since the gas mixture with a high energy content can be delivered for further use as an energy supplier, for example as fuel gas in heating systems and refuse incineration plants and for current generation in gas turbine power stations.

In this case, it is advantageous to compress the gas mixture. The gas mixture, which is under ambient pressure, would assume too large a volume and could therefore not be handled in terms of storage and logistical aspects. As a rule, therefore, the gas mixture is fed to a compressor which compresses the gas mixture which is under ambient pressure. In principle, it is also possible for the sucked-away gas mixture which a high energy content to be intermediately stored under ambient pressure in corresponding vessels and then subsequently to be delivered in steps to the compressor, depending on how the further use as fuel gas is planned.

Compression is understood to mean an operation in which the density of the gas mixture is increased or its volume is reduced. This is possible, since, in contrast to liquids, gases possess no defined volume and therefore always fill the entire available space completely and uniformly. In order to introduce as large a quantity of the gas mixture as possible into a vessel, that is to say to obtain high density, the gas mixture is compressed to a multiple of the gas mixture which is under ambient pressure, that is to say highly.

If the energy content of the gas mixture is low, the gas mixture cannot be used as a fuel gas for energy recovery and is delivered to a consumer unit.

In an embodiment of the method, the sucking away and compression of the gas mixture are carried out by means of a compressor unit.

A compressor unit is a working machine for sucking away and compressing gases and vapours, so that the gas mixture is sucked away out of the tank and compressed by the same unit having a pump and a compressor. At the outlet of the compressor unit, the gas mixture is under a predetermined pressure. The efficiency of the compressor is defined by the ratio of the final pressure to the intake pressure. At a ratio of the final pressure to the intake pressure of three, compressors in the narrower sense are referred to. A multiply used compressor for the compression of gas mixtures is, for example, a liquid-ring compressor.

In a further preferred embodiment of the method, the compressed gas mixture is decanted into a pressure vessel.

In a pressure vessel, the gas mixture, which is under high pressure, can be reliably stored and/or transported. Vessels of this type, which withstand high gas pressure, preferably have a cylindrical or spherical configuration. For example, gas boilers, gasometers and/or cylindrical gas bottles are known. In these, the gas mixture which is under pressure can be stored up to pressures of a few 100 bar for a relatively long period of time.

In a further embodiment, the pressure vessel is a transportable pressure vessel.

Transportable pressure vessels are, for example, compressed-gas bottles, as a rule with a connection and with a valve unit for introducing and discharging the gas mixture stored in the compressed-gas bottle. In this case, the use of compressed-gas bottles is advantageous, since these are available in standardized sizes and the gas mixture which is under pressure can be transported reliably to a location where it is used, for example in a heating system. Compressed-gas bottles typically have a capacity of ten to a few hundred liters.

In a further preferred embodiment, the pressure vessel is a permanently installed pressure vessel in the immediate vicinity of the tank.

Permanently installed pressure vessels can store larger quantities of the gas mixture which is under pressure. Permanently installed pressure vessels are, for example, spherical gas holders or cylindrical gasometers with a capacity of a few thousand to ten thousand liters. Depending on size, they can be installed individually next to a crude-oil tank. There is likewise provision for arranging a plurality of smaller gas holders, grouped, in the vicinity of the crude-oil tank. In this case, it is advantageous that an overall storage capacity of the installed pressure vessel can be adapted relatively flexibly to the incident quantity of gas mixture by increasing or reducing the number of individual gas holders.

In a further beneficial embodiment of the method, the oxygen content of the gas mixture in the tank is determined during the suck-away operation.

The hydrocarbon-containing gas mixture, when it comes into contact with oxygen, forms an ignitable gas mixture. It is therefore advantageous, for safety reasons, to monitor the oxygen content of the gas mixture in the tank. The oxygen may penetrate into the tank during the suck-away operation, for example via air influxes.

In a further beneficial embodiment of the method, nitrogen is used as an inert gas.

Nitrogen makes no chemical bond with the hydrocarbon-containing gas mixture and would replace the oxygen in the event of a possible air influx. The nitrogen is preferably conducted into the interior of the tank under slight excess pressure. Nitrogen is known as a scavenging gas for line systems in which ignitable gases circulate.

In a further beneficial embodiment, a noble gas is used as an inert gas.

Noble gases likewise make no chemical bond with their ambient medium and are non-toxic. Argon is typically used. The noble gas would replace the oxygen in the event of an air influx and thus ensure that no ignitable gas mixture occurs.

In a further beneficial embodiment, the gas mixture is fed from the consumer unit into the tank during the suck-away operation.

As a result, a vacuum occurring because the gas mixture is being sucked away can be compensated, and the gas mixture led into the consumer unit can be used. This could be a cost-effective alternative to the use of inert gases. The use of the gas mixture from the consumer unit is advantageous because the gas mixture is still a pure hydrocarbon-containing gas mixture and has no foreign gases, such as nitrogen or noble gases.

In a further beneficial embodiment, the gas mixture is fed from the consumer unit to a flare unit in order to be burnt off.

By the burn-off, a low-emission combustion of hydrocarbons from the tank is achieved if the gas mixture can no longer be used any further. For this purpose, the gas mixture is converted into a hydrocarbon/air mixture in that air and/or pure oxygen is supplied.

The combustible gas mixture is conducted via a line to a special flare. A blower is preferably installed at a flare inlet of the special flare and presses the flare gases into a flare stack by means of flame and flashback protection. A flare is thus designed such that both gas mixtures with a high hydrocarbon content and gas mixtures below the lower ignition limit can be burnt.

In a further preferred embodiment of the method, a pressure which the gas mixture is under in the tank is determined during the suck-away operation.

It can thereby be monitored whether a vacuum is occurring in the tank. The measured pressure signal may serve for controlling the gas supply for the inert gas or the gas mixture from the consumer unit, so that the interior of the tank is always under ambient pressure. There may also be provision for generating a slight excess pressure in the tank in order to prevent air influxes.

According to the invention, the object is achieved, furthermore, in a device of the type mentioned in the introduction, in that the device has a pump unit with a control unit and with a pump for sucking away the gas mixture out of the tank, a measurement unit for determining the energy content of the gas mixture and/or a compressor unit.

Thus, by means of the device, a gas mixture, which has formed at the bottom of the crude-oil tank on account of hydrocarbons diffused out of the oil sump, can be delivered for further use, the energy content of the gas mixture being determinable by means of the measurement unit and, in the event of a high energy content determined, the latter being compressible by means of a compressor unit.

Advantageously, the compressed gas mixture can be decanted into gas pressure vessels, in order to be delivered for further use as an energy supplier. A gas mixture which cannot be used any further and which has a low energy content can be delivered to a flare device, in order to burn it off with low emission by the supply of air and/or oxygen.

In a preferred embodiment of the device, a measurement unit for determining the oxygen content of the gas mixture is provided.

This measurement unit for determining the oxygen content may be used as a monitoring device, in order to monitor whether the gas mixture has a high oxygen fraction. An ignitable gas mixture can be prevented from occurring by means of suitable measures.

In a further preferred embodiment of the device, the device has a feed unit for feeding an inert gas into the tank.

It is thereby possible to prevent a situation where, in the case of a vacuum which has occurred and which may occur due to the gas mixture being sucked away out of the tank, atmospheric oxygen penetrates into the tank and thus gives rise to an ignitable gas mixture.

In a further preferred embodiment, the pump and the compressor are designed in one unit as a compressor.

By means of the compressor, the gas mixture can be sucked away out of the tank and compressed, so that the gas mixture can be stored in a small volume.

In a further preferred embodiment of the device, the measurement unit for determining the energy content and the pump unit and/or the compressor unit are installed on a vehicle.

The vehicle can, if required, be moved into the vicinity of the crude-oil tank. The crude-oil tank can then be cleaned, the gas mixture first being pumped out of the interior of the tank by means of the pump unit. In this case, the energy content of the gas mixture is determined by means of the measurement unit, and, if the energy content overshoots a limit value, the gas mixture is delivered to a compressor unit. The compressed gas mixture is decanted into compressed-gas vessels and is then available for further use. A mobile, movable unit has thereby been provided, which can be used successively for cleaning a large number of crude-oil tanks of a tank installation.

According to the invention, the object is achieved, furthermore, in a cleaning vehicle for cleaning a tank, preferably a crude-oil tank, in that the cleaning vehicle has a measurement unit for determining the energy content of a gas mixture located in the tank to be cleaned and a pump unit for pumping away the gas mixture out of the tank.

Cleaning vehicles are used, as standard, for cleaning a tank, the cleaning vehicles removing the oil sump from the interior of the tank. An additional installation of a pump unit and of a measurement unit for determining the energy content of the sucked-away gas mixture is advantageous, since the gas mixture can be sucked away on the spot and, depending on how high the measured energy content is, can be burnt off or compressed, for example outside the tank.

In a preferred embodiment of the cleaning vehicle, a measurement unit for determining an oxygen content of the gas mixture in the tank is provided.

The oxygen content can thereby be monitored and the gas mixture prevented from being converted into a ignitable gas mixture. The signal from the measurement unit may be used, for example, for controlling a supply of an inert gas.

In a further embodiment, there is provision for the cleaning vehicle to have a device for compressing the gas mixture.

As a result, the compression and, preferably, the decanting of the gas mixture into compressed-gas vessels can take place on the cleaning vehicle. A mobile unit is thereby provided, by means of which the tank is cleaned and the gas mixture is prepared in compressed-gas vessels for further use. This may be, for example, a cleaning vehicle which, as a mobile unit, cleans smaller tanks or tanks on floating tankers, etc. In this case, the cleaning vehicle has a device for sucking away a gas mixture, a measurement unit for determining the energy content, a compressor for compressing the gas mixture and, preferably, a possibility for decanting the compressed gas into the compressed-gas vessel.

It will be appreciated that the features mentioned above and those yet to be explained below can be used not only in the combination specified in each case, but also in the other combination or alone, without departing from the scope of the present invention.

BRIEF DESCRIPTION OF THE SEVERAL VIEWS OF THE DRAWING

Further features and advantages of the invention may be gathered from the following description of the figures of the drawing in which.

DETAILED DESCRIPTION OF THE INVENTION

Figure 1:
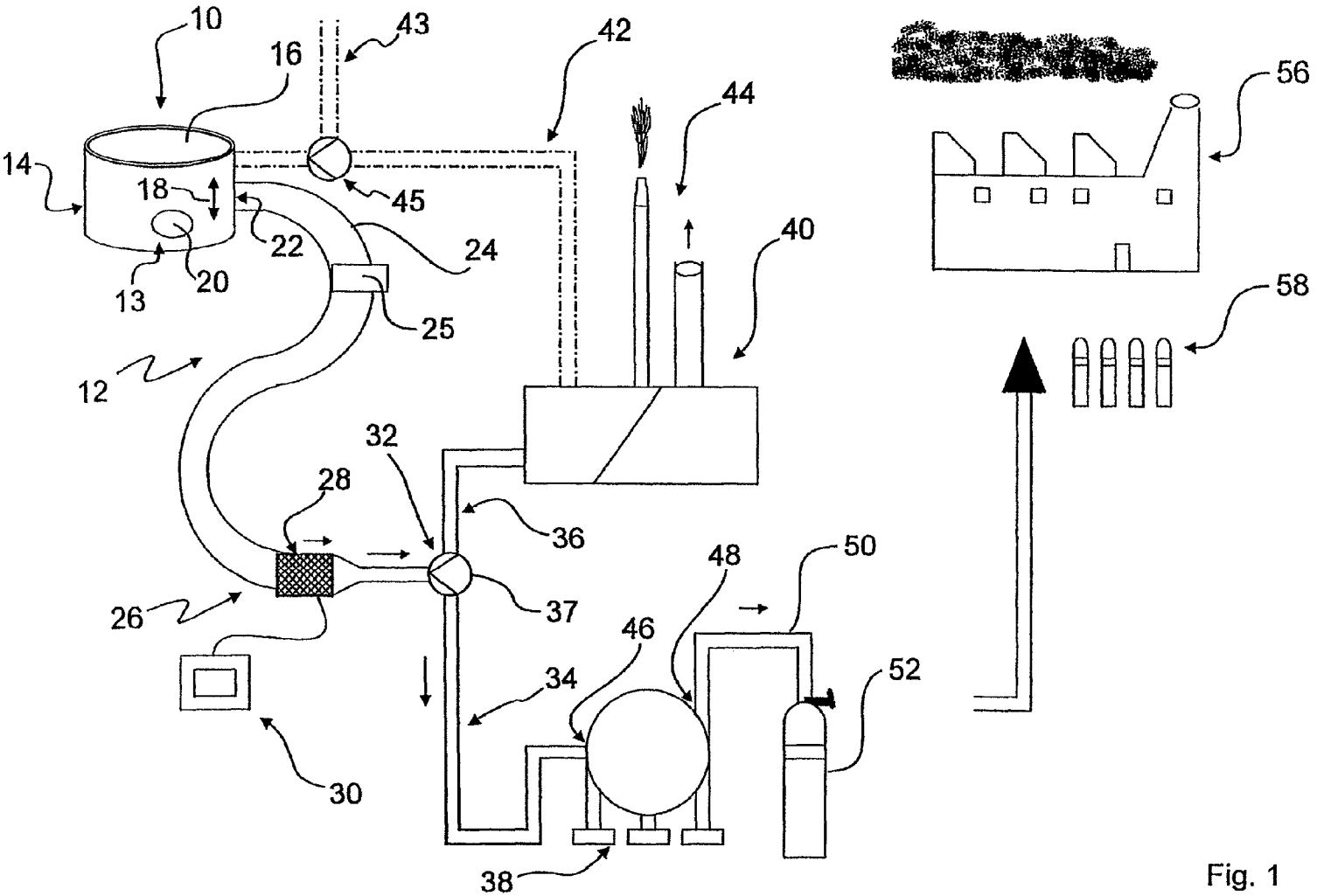
FIG. 1 shows a diagrammatic illustration of a device for sucking away a gas mixture out of the crude-oil tank, with a flare unit and with a compressor unit for decanting the gas mixture into compressed-gas vessels.

FIG. 1 shows a crude-oil tank 10 in a diagrammatic illustration and also a device 12 for sucking away a gas mixture out of the crude-oil tank. In this case, the illustrations of the crude-oil tank 10, which is shown in perspective, and of the device 12 are not true to scale.

The crude-oil tank 10, designed as a floating-top tank, has, as a rule, a circular tank bottom 13 which is surrounded circumferentially by a firmly connected tank wall 14. The crude-oil tank 10 has, furthermore, a tank roof 16 which, when the crude-oil tank 10 is full, floats on the introduced crude oil and is guided movably up and down in the cylindrical tank wall 14 in a vertical direction indicated by the arrow 18.

To stabilize the tank roof 16, the crude-oil tank 10 has, furthermore, a plurality of tank-roof stays, not illustrated here, which carry the tank roof 16 when there is no crude oil in the tank 10. Furthermore, the crude-oil tank 10 has manholes which are arranged circumferentially on the tank wall 14 and of which only one manhole 20 is shown representatively.

The crude-oil tank 10 has on the tank wall 14 a port 22, to which the device 12, more specifically a preferably flexible hose 24 of the device, can be connected. A measurement unit 26 for measuring an energy content of a gas mixture located in the tank 10 is arranged on the hose 24, the measurement unit 26, as a rule, having a measuring sensor 28 and a control and regulation unit 30.

A branch 32 is connected to the line 24, the branch 32 issuing into a first line 34 and a second line 36. The branch 32 has a valve 37 which is preferably activatable and is set, depending on which of the lines 34 and 36 is to be released.

In this case, the line 36 is closed when the gas mixture is to flow into the line 34, and vice versa. The valve 37 is preferably activatable by an output signal from the measurement unit 26. It is also possible, however, to feed the output signal from the measurement unit 26 to a central control unit, not illustrated here, of the device 12, which is also designated as a fuel-gas recovery plant 12, which then controls the valve 37.

The first line 34 leads to a compressor plant 38 in which the gas mixture is compressed, that is to say put under a higher pressure than that prevailing on the inlet side. The second line 36 leads to a consumer unit 40. The consumer unit 40 has a flare unit 44, in which the gas mixture can be burnt off in a controlled way and with low emission.

By means of a third line 42, the gas mixture fed to the consumer unit 40 may optionally be reintroduced into the crude-oil tank 10. The line 42 is then preferably connected to a line 43 which is connected to a reservoir of inert gas, not illustrated here. Both lines 42 and 43 are connected by means of a valve 45 which is activatable. One line or the other is released, depending on which gas is to be fed to the interior of the tank 10. The line 43 may also be connected to the crude-oil tank 10 independently of the line 42.

The compressor unit 38 may be designed as a compressor unit which has a pump unit with a pump 25 and a compressor unit 38. At the inlet 46 of the compressor unit 38, the pumped-in gas mixture is supplied, and, at the outlet 48, the gas mixture is fed through a line 50 to a respective compressed-gas vessel 52.

In this case, the gas mixture is preferably decanted into compressed-gas vessels 52 designed as compressed-gas bottles 58. In the compressed-gas vessels 52, 58, the compressed gas mixture which is under pressure and has a higher fraction of combustible hydrocarbon compounds can be delivered to a consumer which burns the gas mixture, for example in a heating system, and thus extracts energy from the gas mixture. There may be provision, furthermore, for the compressed-gas bottles 58 to be consumed and/or stored in a factory 56 and to be delivered to customers according to requirements.

Figure 2:
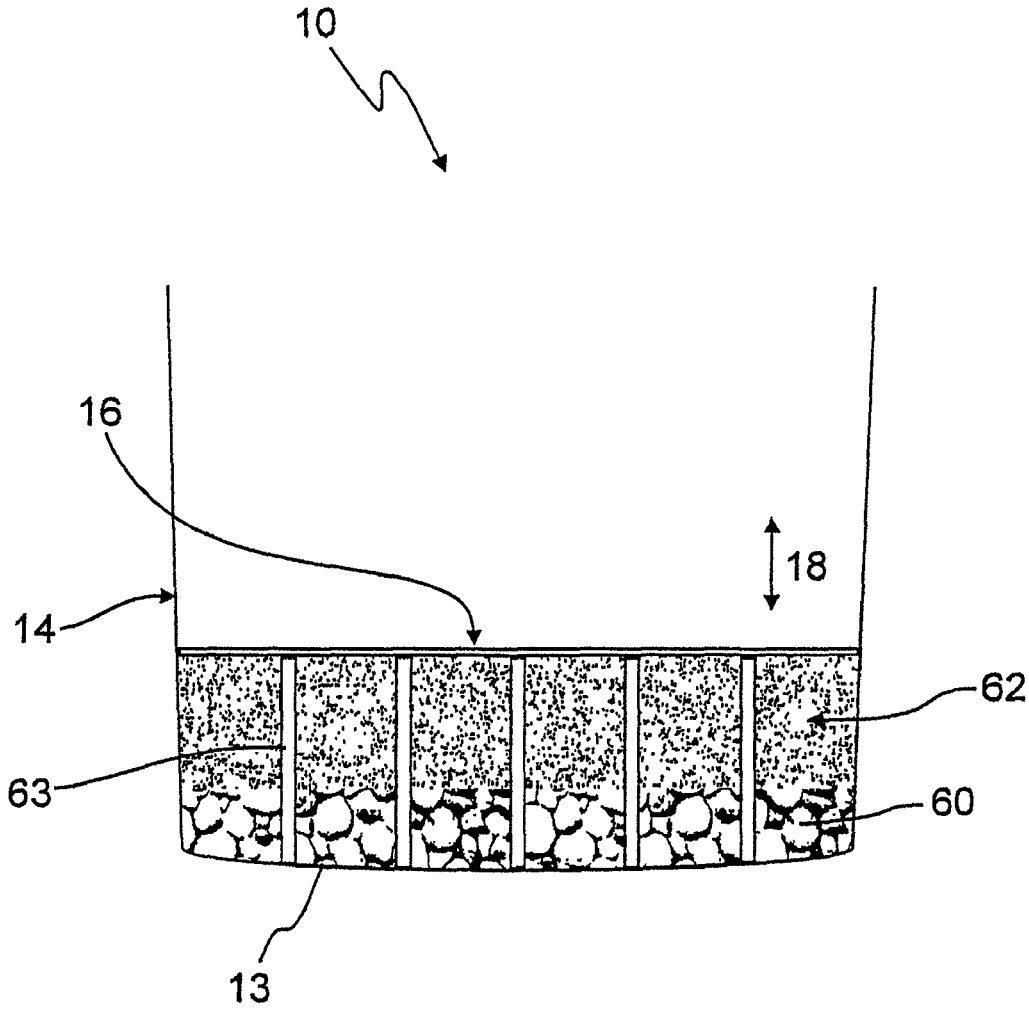
FIG. 2 shows a crude-oil tank in a sectional illustration.

FIG. 2 shows the crude-oil tank 10 in longitudinal section, the crude oil being discharged. On the tank bottom 13 of the crude-oil tank 10 is shown a crude-oil sump 60, designated as gatch, which has formed due to deposits of impurities and from heavy constituents of the crude oil in the course of a period of use of the crude-oil tank 10. Above the crude-oil sump 60 is formed a gas mixture 62 which has volatile hydrocarbon compounds. This is, as a rule, a gas and/or vapour mixture 62 which, as a rule, may have both purely gaseous constituents, mainly volatile hydrocarbon compounds, and vapour with crude oil dissolved as very fine droplets. The tank-roof stays, not shown in FIG. 1, are likewise shown and designated by the reference numeral 63. The tank roof 16 lies on the tank-roof stays 63 when the crude oil is discharged from the tank 10.

The method whereby the cleaning of the crude-oil tank 10 is carried out will be described briefly below: in the crude-oil tank 10, a crude-oil sump 60 has occurred in the course of time, which, as a rule, has hydrocarbon compounds deposited as solids. After the crude oil has been discharged, the tank roof 16 lies on the tank-roof stays 63. The gas mixture 62 has formed underneath. The gas mixture 62 is sucked away by means of the pump 25 and fed through the hose 24 to the measurement unit 26 for measuring the energy content of the gas mixture 62. Depending on how high the energy content of the gas mixture 62 is, the valve 37 is switched in such a way that the gas mixture passes through the line 34 into the compressor plant 38 or the gas mixture passes into the line 36 and consequently into the consumer unit 40. In this case, the valve 37 is controlled in such a way that, in the case of a high energy content, the gas mixture 62 is fed to the compressor unit 38 and, in the case of a low energy content, the gas mixture 62 is fed to the consumer unit 40.

The compressor unit 38 compresses the gas mixture 62 so that it can be decanted into pressure vessels 52, 58. The consumer unit 40 comprises a flare unit 44, in which the gas mixture 62 can be burnt off, and is optionally connected to the tank 10 by means of a line 42, so that the gas mixture with a low energy content can be fed to the interior of the tank 10.

Furthermore, there is provision for the measurement unit 26 to have a measuring sensor 28 for determining the energy content of the gas mixture 62 and a probe for determining the oxygen content in the crude-oil tank 10. The energy content may be determined by means of various methods. In this context, the term "measuring sensor 26" may also embrace a more complex device, such as, for example, a gas chromatograph, or a device comprising an infrared sensor for measuring the infrared radiation of a specific wavelength absorbed by the gas mixture.

The oxygen content may be fed to an indicator unit, not illustrated here, and serve for monitoring purposes. It may, however, also serve for controlling the feed of inert gas into the interior of the tank 10. By the feed of inert gas, the gas mixture 62 can be prevented from being converted into an ignitable gas mixture if, for example, air has penetrated into the tank interior of the crude-oil tank 10 due to leakages.

There is provision for the device 12 to be mountable on a vehicle, the pump unit 25 and the measurement unit 26 and/or the compressor 38 being installed on the vehicle. By means of the vehicle, which is not illustrated here, a plurality of crude-oil tanks 10 can be serviced by the same device 12 installed on the vehicle. The vehicle can be brought successively next to the respective tank 10, the gas mixture 62 of which is to be sucked away, and can be remain installed there for the duration of the sucking away and/or compression of the gas mixture 62, before it is moved to the next tank 10.

Furthermore, there may be provision for the device 12 to be mounted on a cleaning vehicle which can be introduced into the crude-oil tank 10 in order to clean the interior of the latter. In this case, either the complete device 12 or only the pump 25 and/or the pump unit and/or the measurement unit 26 may be installed on the cleaning vehicle.

What is claimed is:

1. A method for the internal cleaning of a tank, containing an oil sump and a gas mixture having a hydrocarbon-containing gas, wherein the gas mixture is diffused out of the oil sump, comprising the following steps:

sucking away the gas mixture out of the tank and permitting a feed of an inert gas into the tank;

determining an energy content of the sucked-away gas mixture;

feeding the gas mixture into a compressor for compressing the gas mixture, if the energy content of the gas mixture overshoots a limit value, in order to compress the gas mixture in the compressor;

feeding the gas mixture into a consumer unit, if the energy content of the gas mixture undershoots the limit value.

2. The method according to claim 1, wherein sucking away and compression are carried out by means of a compressor unit.

3. The method according to claim 1, wherein the compressed gas mixture is decanted into a pressure vessel.

4. The method according of claim 3, wherein the pressure vessel is a transportable pressure vessel.

5. The method according to claim 3, wherein the pressure vessel is a permanently installed pressure vessel in immediate vicinity of the tank.

6. The method according to claim 1, wherein oxygen content of the gas mixture in the tank is determined during the suck-away operation.

7. The method according to claim 1, wherein nitrogen is used as the inert gas.

8. The method according to claim 1, wherein a noble gas is used as the inert gas.

9. The method according to claim 1, wherein the gas mixture is fed from the consumer unit into the tank during the suck-away operation.

10. The method according to claim 1, wherein the gas mixture is fed from the consumer unit to a flare unit in order to be burnt off.

11. The method according to claim 1, wherein a pressure which the gas mixture is under in the tank is determined during the suck-away operation.

* * * * *